United States Patent [19]

Bongiovanni

[11] 4,075,805

[45] Feb. 28, 1978

[54] BUILDING PANEL WITH ATTACHED SEALING MEANS

[76] Inventor: John P. Bongiovanni, 19 Bates Road, Chester, Conn. 06412

[21] Appl. No.: 771,085

[22] Filed: Feb. 23, 1977

[51] Int. Cl.[2] ..... E04B 1/62; E04C 1/10

[52] U.S. Cl. ..... 52/309.12; 52/394; 52/595

[58] Field of Search ..... 52/309.4, 309.12, 309.17, 52/393, 394, 592–595, 599

[56] References Cited

U.S. PATENT DOCUMENTS

| | | | |
|---|---|---|---|
| 2,718,829 | 9/1955 | Seymour et al. | 52/309.17 |
| 3,000,144 | 9/1961 | Kitson | 52/309.12 |
| 3,167,882 | 2/1965 | Abbott | 52/309.17 X |
| 3,209,502 | 10/1965 | Donegan | 52/394 |
| 3,376,629 | 4/1968 | Baumann et al. | 52/309.17 |
| 3,731,441 | 5/1973 | Dixon | 52/394 |

FOREIGN PATENT DOCUMENTS

| | | | |
|---|---|---|---|
| 2,292,086 | 11/1974 | France | 52/309.12 |
| 529,073 | 6/1955 | Italy | 52/309.17 |
| 856,677 | 12/1960 | United Kingdom | 52/309.12 |

*Primary Examiner*—J. Karl Bell
*Attorney, Agent, or Firm*—McCormick, Paulding & Huber

[57] ABSTRACT

A square panel includes base of expanded polystyrene, and has two adjacent sides with projecting edges adapted to mate with the undercut sides of two identical adjacent panels. All four sides of the base are preferably bevelled, and the front face defines intersecting grooves so that a polymer fortified concrete facing can be applied to the front of the base without warping the base as the concrete shrinks during hardening. An acrylic binder, preferably with quartz granules carried therein, is provided over the concrete facing to enhance the appearance of the panel, and to improve its resistance to impact. The panels are assembled to an existing wall structure or the like by applying mastic to the rear face of the panels, and a strip of foam expanded polyvinyl chloride tape of the nonporous variety is adhered to the adjacent edges of the panel which define the projecting portion thereof so as to facilitate assembling of the panels and to provide a water tight exterior wall.

9 Claims, 4 Drawing Figures

BUILDING PANEL WITH ATTACHED SEALING MEANS

CROSS REFERENCE TO RELATED APPLICATION

This application is related to a copending application assigned to the applicant herein entitled "Building Panel" filed July 21, 1975 under Ser. No. 597,659.

SUMMARY OF THE INVENTION

This invention relates generally to building panels, and deals more particularly with a light-weight building panel with superior heat insulating properties, which panel is especially well-suited for use on a structural wall for further insulating the same, and to improve its appearance, and also to improve its moisture resistant qualities particularly in the area where adjacent panels are butted one against another to assemble the panels at a job site.

A building wall panel incorporating the present invention comprises a system of interfitting, shiplapped panels, each of which panels has a base of expanded polystyrene or other material of equal heat insulating properties. Each such panel base further includes a facing of polymer fortified concrete or other cementitious material, which facing is formed directly on the front face of the panel base. The front face of the panel base defines intersecting grooves which are filled with the cementitious facing material thereby forming ribs of concrete which serve to prevent warping of the base as the concrete shrinks during the hardening process, and also adding to the strength of the overall panel with a fraction of the weight required in prior art concrete building panels. An important feature of the panel described herein comprises the application of an expanded polyvinyl chloride tape of nonporous cellular construction to the adjacent side edges of the panel which define the projecting portion of adjacent edges of such panel which serve to overlap one another in the completed wall. Finally, another feature of the novel building panel comprises the application of quartz granules in a polymer fortified binder applied to the concrete facing so that the panel is not only an efficient insulator, but so that the panel is also provided with a distinctive appearance, and so that the panel has improved resistance to impact.

DETAILED DESCRIPTION

Figure 1:
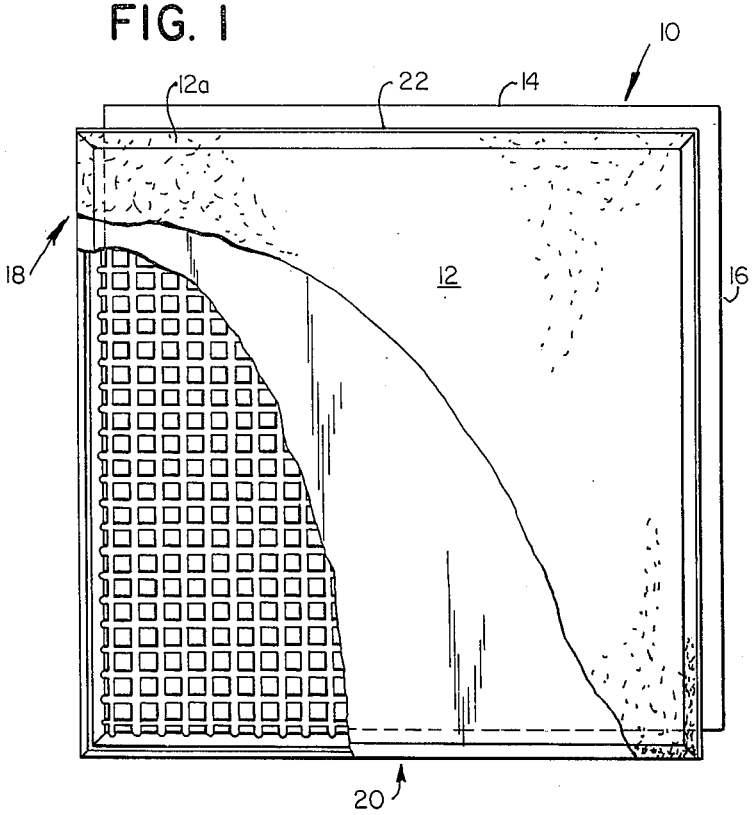
FIG. 1 is a plan view of one of the panels, with portions of the facing and the quartz granule bearing binder broken away to reveal the grid like structure which serves to anchor the cementitious facing to the polystyrene base.
Figure 2:
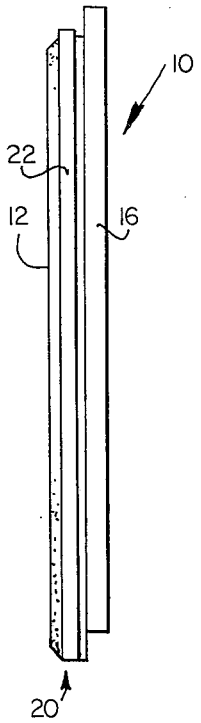
FIG. 2 is a side elevational view of the FIG. 1 panel.
Figure 3:
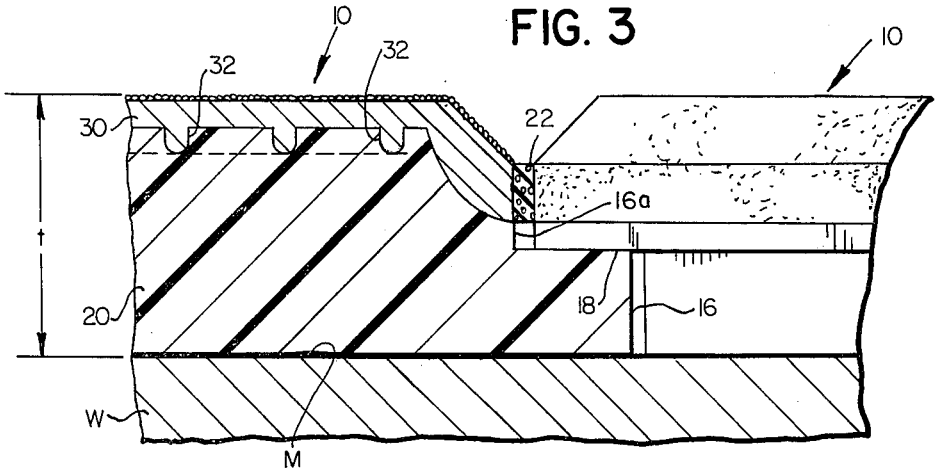
FIG. 3 is a sectional view taken through an existing wall structure and through one of two FIG. 1 panels with the sealant type of the present invention oriented in position to seal the exterior surface of the wall from the outside atmospheric conditions.

Turning now to the drawings in greater detail, FIG. 1 shows a single square panel 10 incorporating the present invention, and such panel includes a bevelled front face 12, the bevelled edge being indicated generally **12*a*, and which panel also includes two adjacent projecting edges 14 and 16, which edges are adapted to mate with the undercut or relieved side edges of two identical adjacent panels such as indicated generally at 18 and 20 in the FIG. 1 panel. FIG. 3 shows the manner in which these edges abut one another with a sealant tape 22 provided therebetween. This tape 22 not only serves to seal the exterior surface of the resulting structure from outside atmospheric conditions, but also serves to permit the workman in assembling the panels to make up for variations in the underlying wall structure W necessarily arising from the fact that the panels themselves are mass produced to strict quality control standards and therefrore have a predetermined size and shape. Contractors generally will recognize the fact that the existing wall W will never be of perfectly regular configuration with the result that variations must be introduced into the orientation of each of the panels being assembled to the wall W, and the tape 22 is of a character such that these variations can be readily accommodated in the space between the adjacent panels in a manner similar to that used by contractors generally in constructing a brick veneer wall for example. However, a contractor will have to accommodate such variations in the irregularity of the underlying wall in constructing a prior art brick veneer wall by using more or less mortar between the various courses of brick which he lays. In assembling a wall in accordance with the teaching of the present application the workman will be able to align the successive panels in a much easier manner as a result of the fact that the tape 22** is readily compressible, and it should also be noted that the appearance of the tape is a gray/black color so that on inspection the completed wall will give the appearance that mortar has actually been used in the joint between the adjacent panels.

While the panel system of the above mentioned copending application does serve to waterproof the wall as a result of the shiplapped edges, it will be apparent that the mortar required to assemble the system described therein will take considerably longer to apply to the panels and that the preassembled tape provided in accordance with the present invention will yield a much improved panel construction such that the other advantages of the system in the copending case will be achieved. More particularly, the unique facing for the panel in both this and the copending application provide a considerable degree of protection for the resulting wall both in terms of its resistance to temperature changes, and also in terms of its durability as a result of its relatively high impact resistance. Additionally, the wall systems of the copending application and also in the system disclosed herein provide a very economical construction, and also provide a very light weight construction, as a result of which the system can be quickly and easily applied at a cost less than prior art brick veneer walls for example.

The panel illustrated in FIG. 1 is square, and preferably 24 inches on a side. It will of course be understood that other regular polygonal configurations might be adopted, and that the size is not critical to the design concept described and claimed herein. However, the weight of the panels is such that a panel approximately 24 inches on a side, and slightly over 2 inches in thickness, is of a convenient size and weight for easy handling in the process of assembling the panels to a structural wall as suggested in FIG. 3.

Turning now to a more detailed description of the construction for the panel 10 of FIG. 1, FIG. 3 illustrates the cross sectional configuration of the panel, and also shows an adjacent panel so as to better illustrate the manner of shiplapping adjacent panels to provide an effective thermal and moisture resistant barrier well adapted to insulate and protect an exterior building wall. It is noted that the thixotrophic waterproof adhesive can be used for applying the expanded polystyrene panels to the concrete block wall structure W, but this adhesive or mastic used to apply the panels to the wall is preferably not applied to the joint between the adjacent panels, but on the contrary a tape 22 of expanded polyvinyl chloride material grey/black in color and nonporous in cellular construction is applied adhesively to the two adjacent sides of the panel 10 associated with the projecting edges 14 and 15 such that a peel-off paper protective sheet can be removed from the exterior of the tape by the workman at assembly in order to facilitate joining the next panel to the one already assembled on the wall.

As mentioned previously the panel 10 comprises a base 20, which is preferably fabricated of a light weight material having exceptional thermal heat transfer resistance, such characteristics being found with an expanded polystyrene of the type sold by several suppliers under various trademarks in both its expanded and the pellet form (STYROFOAM andPLASTIFOAM etc.). Such a material is presently preferred due to another characteristic in addition to its good insulating properties, that is its relatively low cost. As shown in FIG. 3 the base 20 has a cementitious facing material 30 applied to the front face of the base such that the overall thickness t is on the order of 2–2 ½inches as described previously. It is further noted that the projecting edge 16 of the panel 10 comprises slightly more than one third the thickness of the overall panel, and that the cavity defining portion 18 of the adjacent panel is correspondingly shaped. Thus, the portion **16*a* of the edge of the panel 10 which carries the sealant tape 22 also comprises approximately one third the overall thickness t of the panel 10** as shown.

The facing 30 of the panel 10 preferably comprises a cementitious material, and more particularly a polymer fortified concrete material which is applied to the panels to a depth such as that indicated generally in FIG. 3. This depth is preferably on the order of three sixteenths to one fourth of an inch, but could conceivably take the form of a minimal one eighth inch depth or a maximum one half inch depth depending upon the overall geometry of the panel itself. It is noted that at least in its presently preferred form the square panel of approximately 24 inches on a side is preferably provided with this cementitious material to a depth of three sixteenths to one fourth of an inch (exclusive of the ribs 32, 32). The ribs are formed as a result of the fact that mutually perpendicular grooves are provided in the front face of the panel 20 as best shown in FIG. 1.

It should also be noted that the side edges of the panel 10 are preferably bevelled with the cementitious facing portion applied to the bevelled portion of the base as well so that the completed panel has a bevelled edge configuration which is not only pleasing to the eye when the panels are assembled in a wall as shown in FIG. 3, but which bevelled edge also serves to strengthen the cementitious facing 30 to the polystyrene base. This configuration is important because of the fact that upon application of the polymer fortified concrete to the base the concrete will tend to shrink as it hardens exerting stress on the expanded polystyrene base 20. Without the ribs 32 and the bevelled edge as shown in FIG. 3 this shrinkage would tend to warp the expanded polystyrene base and render it virtually useless for the intended purpose, namely to adhere these panels to an existing wall structure such as that indicated generally at W in FIG. 3.

The facing material 30 described above has considerable strength in and of itself, but in order to further improve its impact resistance, and also to improve its appearance, quartz particles are provided in a polymer binder to the facing as indicated generally at 12 in FIG. 1. The same polymer or acrylic material might be utilized for such a binder as is provided in fortifying the cementitious or concrete facing material described previously. The thickness of this binder material and the quartz particles therein is preferably on the order of one sixteenth of an inch. The reader is referred to the copending application mentioned at the outset of this specification for a more detailed description of the base, the facing, and this acrylic binder with the quartz granules therein.

The important feature of the present disclosure relates to the provision of an expanded polyvinyl chloride tape 22 to the area indicated generally at **16*a* of the side edge of the panel 10 associated with the projecting edges 14 and 16. This tape is preferably grey or black in color and such material is available with adhesive applied to both sides, and with a peel-off paper tape associated with one or both sides thereof depending upon the manner in which the tape is sold. Norton Sealants Company of Granville, New York sells such a tape suitable for the purpose disclosed herein under the trademark NORSEAL V783 and V778. As mentioned previously this tape 22 is applied to two of the four sides of the panel 10 and preferably the two sides associated with the projecting edges 14 and 16. The exposed adhesive bearing edge of the tape 22 is covered with a peel-off paper strip such that the adhesive does not become oxidized prior to the panel being assembled to a wall, and so that the workman in assembling a wall from these panels need only remove the peel-off paper strip in order to assemble the panels one abutting another as illustrated in FIG. 3**.

Figure 4:
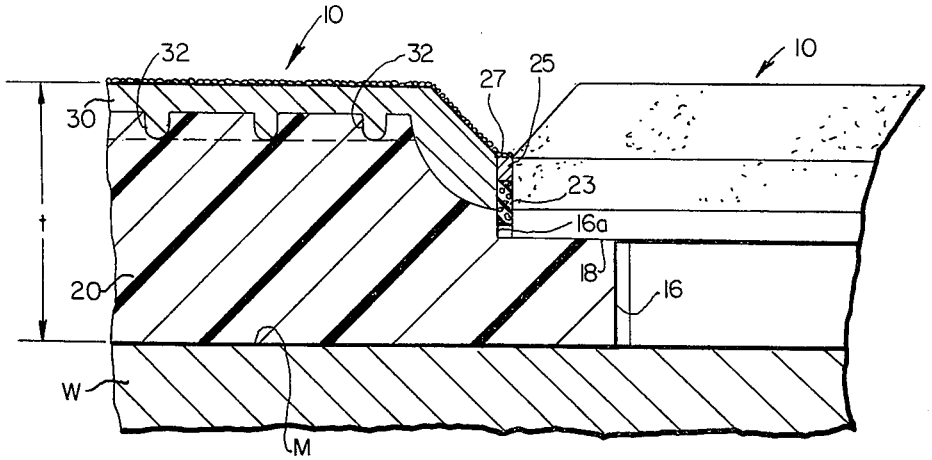
FIG. 4 is a view similar to FIG. 3 but showing a modified form of sealing means.

FIG. 4 shows a modified form for the sealing means carried by two adjacent edges or sides of the panel 10 described above. Whereas the strip or tape 22 described above served as the sole means for scaling the joint between the butted or shiplapped panels, the FIG. 4 version shows a narrower tape or strip 23 applied in the same manner as the strip or tape 22, but in FIG. 4, the sealing means further includes a bead 25 of caulking compound, and may also include decorative granules 27 similar to those applied to the facing, and preferably these granules have a characteristic color identical to those applied to the facing. This, tends to give the installation a customized appearance because of the lack of attention drawn to the joint area by using the granules to give this area the same appearance as the panels themselves.

The FIG. 4 is otherwise similar to that shown and described with reference to FIG. 3, and similar reference numerals have been used to call out similar parts of the structure. The panels 10, 10 are applied to the wall W by a commercially available mastic M in both versions.

I claim:

1. An exterior wall panel for assembly with other identical panels, and comprising a base of heat insulating material, said base having a rear face adapted for attachment to a wall structure or the like, and said base having a front face defining grooves, said base being of generally regular polygonal outline with at least two adjacent sides defining projecting edges and located adjacent the rear face of the base, said adjacent sides having portions adjacent the front face of the base which portions are of a thickness approximately equal to the thickness of said projecting edges, said panel edges opposite said adjacent edges defining undercut relieved cavities to receive the projecting edges of at least two adjacent panels, a polymer fortified cementitious facing on said grooved front face, and a strip of nonporous compressible foam type tape with adhesive on both sides applied to said adjacent two sides so that a paper peel-off strip may be provided on the outside of said foam tape to be peeled off after the panel has been attached to such wall structure and before the two adjacent panels are attached to said wall structure.

2. The panel defined in claim 1 wherein the regular polygonal configuration of said panel is rectangular and wherein the grooves provided in the front face of the base are arranged in mutually perpendicular directions parallel to the sides of said rectangle.

3. The panel defined in claim 1 wherein the front face of said base is bevelled, and wherein the polymer fortified cementitious facing is also bevelled so as to anchor the facing to the panel, said facing having a thickness no greater than one third the overall thickness of the base plus said facing.

4. The panel defined in claim 3 wherein the layer of polymer material is adhered to the facing.

5. The panel defined in claim 4 wherein said tape comprises an expanded polyvinyl chloride material with adhesive on both sides, and a peel-off paper strip adhered to the exposed side of said tape.

6. The panel defined in claim 4 wherein said tape has a color contrasting to the color of said layer of polymer material, said polymer material having quartz granules bound therein, which quartz granules have a characteristic color.

7. The panel defined by claim 1 further characterized by said tape having a width narrower than the side edge of the panel to which it is applied, and a bead of caulking compound applied over the tape.

8. The panel defined by claim 6 further characterized by said tape having a width narrower than the side edge of the panel to which it is applied, and a bead of caulking compound applied over the tape.

9. The panel defined by claim 8 further characterized by quartz granules applied to the outer surface of said caulking bead.

* * * * *

UNITED STATES PATENT OFFICE

CERTIFICATE OF CORRECTION

Patent No. 4,075,805 Dated February 28, 1978

Inventor(s) John P. Bongiovanni

It is certified that error appears in the above-identified patent and that said Letters Patent are hereby corrected as shown below:

Column 1, Line 58, "type" should be --tape--.

Column 2, Line 14, "therefrore" should be --therefore--.

Column 3, Line 17, "15" should be --16--.

Column 4, Line 35, "V783" should be --V738--.

Signed and Sealed this

Sixth Day of June 1978

[SEAL]

*Attest:*

RUTH C. MASON
*Attesting Officer*

DONALD W. BANNER
*Commissioner of Patents and Trademarks*